US007789715B2

(12) United States Patent
Noda

(10) Patent No.: US 7,789,715 B2
(45) Date of Patent: Sep. 7, 2010

(54) TERMINAL FITTING WITH POSTURE CORRECTING EDGE AND INCLINATION RESTRICTING PORTION AND A CONNECTOR PROVIDED THEREWITH

(75) Inventor: Masahiro Noda, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/431,841

(22) Filed: Apr. 29, 2009

(65) Prior Publication Data

US 2010/0062658 A1 Mar. 11, 2010

(30) Foreign Application Priority Data

Sep. 10, 2008 (JP) ..... 2008-231883

(51) Int. Cl.
*H01R 4/18* (2006.01)
*H01R 4/72* (2006.01)

(52) U.S. Cl. ..... 439/730

(58) Field of Classification Search ..... 439/730, 439/733.1, 722, 852
See application file for complete search history.

(56) References Cited

U.S. PATENT DOCUMENTS 3,423,718 A * 1/1969 Carmen ..... 439/430
4,979,913 A 12/1990 Aiello et al.
5,567,185 A * 10/1996 Henderson et al. ..... 439/733.1
6,325,680 B1 12/2001 Suzuki
6,375,501 B1 4/2002 Kojima

FOREIGN PATENT DOCUMENTS

JP 2005-222815 8/2005

* cited by examiner

*Primary Examiner*—Javaid Nasri
(74) *Attorney, Agent, or Firm*—Gerald E. Hespos; Michael J. Porco

(57) ABSTRACT

An insulation barrel (24) of a terminal fitting (20) is formed with an inclination restricting portion (32) capable of restricting an inclination of the terminal fitting (20) in a direction intersecting an axial line direction by contacting an inner wall of a cavity (11) and a posture correcting portion (31) inclined with respect to the axial line direction of the terminal fitting (20) and capable of sliding contact with an opening edge at the rear end of the cavity (11) in the process of inserting the terminal fitting (20) into the cavity (11).

11 Claims, 3 Drawing Sheets

TERMINAL FITTING WITH POSTURE CORRECTING EDGE AND INCLINATION RESTRICTING PORTION AND A CONNECTOR PROVIDED THEREWITH

BACKGROUND OF THE INVENTION

1. Field of the Invention

The invention relates to a terminal fitting, and to a connector.

2. Description of the Related Art

Japanese Unexamined Utility Model Publication No. 2005-222815 discloses a connector constructed by inserting a terminal fitting into a housing. The terminal fitting includes an open wire barrel at a rear end. The wire barrel is crimped into electrical connection with a conductor exposed by removing an insulation coating of a wire. The wire connected with the terminal fitting then is drawn out of the housing.

Copper with relatively low rigidity is used as a conductor in a general wire. The use of a material that is more rigid than copper (e.g. aluminum) or a material with lower electrical conductivity than copper (e.g. aluminum) leads to a thicker conductor and may result in a more rigid conductor. The wire drawn backward out of the housing may be displaced by an external force acting in a direction intersecting the draw-out direction from the housing. Displacement of a rigid wire could cause the terminal fitting to incline in the housing. Thus a change in the posture of a rigid wire could make a contact state with a mating terminal may unstable and contact reliability may be reduced.

The present invention was developed in view of the above situation and an object thereof is to prevent a terminal fitting from being inclined in a housing upon receiving an external force acting in a direction intersecting with a draw-out direction from the housing.

SUMMARY OF THE INVENTION

The invention relates to a terminal fitting to be inserted into a cavity of a housing of a connector. The terminal fitting has opposite front and rear ends. A terminal connecting portion is near the front end and functions as connecting means with a mating terminal. A wire connecting portion is behind the terminal connecting portion and is configured to be connected with a conductor of a wire. The wire connection portion is formed with at least one inclination restricting portion for restricting an inclination of the terminal fitting in a direction intersecting an axial line direction by contacting an inner wall of the cavity. The wire connecting portion also has at least one posture correcting portion inclined with respect to the axial line direction of the terminal fitting and capable of sliding contact with an opening edge at the cavity in the process of inserting the terminal fitting into the cavity. The inclination restricting portion prevents inclination of the terminal fitting even if an external force acts on the wire in a direction intersecting with a draw-out direction from the housing.

The outer diameter of the wire may be smaller than the terminal connecting portion. Thus, the terminal fitting may be inserted in an inclined posture due to a clearance between the inner wall of the cavity and the insulation barrel. However, the wire connection portion is formed with the posture correcting portion that is inclined with respect to the axial line of the terminal fitting. Therefore, the posture of the terminal fitting can be corrected by the sliding contact of the posture correcting portion with the opening edge of the terminal insertion opening at the cavity even if the terminal fitting is inserted into the cavity in an inclined posture.

The inclination restricting portion preferably is continuous with the posture correcting portion.

The wire connecting portion preferably has at least one wire barrel to be crimped into connection with the conductor exposed by removing an insulation coating of the wire, and/or at least one insulation barrel to be crimped into connection with a part of the wire surrounded by the insulation coating.

The insulation barrel portion preferably is formed with the at least one inclination restricting portion and/or the at least one posture correcting portion.

At least one projection preferably is formed by the extending ends of one or more crimping pieces of the insulation barrel and projects out upon crimping the insulation barrel into connection with the wire.

The projection preferably includes at least one lateral plate having a substantially triangular or pointed shape or a substantially trapezoidal shape when viewed in a lateral direction orthogonal to an axial line of the wire are put together. The projection preferably is formed continuously from the front end to the rear end of the insulation barrel.

The invention also relates to a connector, comprising a housing with at least one cavity therein and at least one of the above-described terminal fittings. The terminal fitting is inserted into the cavity in an inserting direction. The connector is used with a wire that has a conductor surrounded by an insulation coating. The wire connecting portion of the above-described terminal fitting is connected with the conductor exposed by removing the insulation coating and with a part of the wire surrounded by the insulation coating. More particularly, the wire connecting portion preferably includes a wire barrel that is crimped into connection with a front end portion of the conductor exposed by removing the insulation coating and an insulation barrel that is crimped into connection with a part of the wire surrounded by the insulation coating. The wire preferably is drawn backward out of the housing.

The insulation barrel preferably is formed with an inclination restricting portion for restricting an inclination of the terminal fitting in a direction intersecting an axial line direction by contacting an inner wall of the cavity. The insulation barrel also preferably has a posture correcting portion inclined with respect to the axial line direction of the terminal fitting and capable of sliding in contact with an opening edge at the rear end of the cavity in the process of inserting the terminal fitting into the cavity. Thus, the terminal fitting will not incline even if an external force acts on the wire in a direction intersecting a draw-out direction from the housing.

The outer diameter of the wire may be smaller than the terminal connecting portion. Thus, the terminal fitting may be inserted in an inclined posture due to a clearance between the inner wall of the cavity and the insulation barrel. However, the insulation barrel is formed with the posture correcting portion inclined with respect to the axial line of the terminal fitting. Therefore, the posture of the terminal fitting is corrected by the sliding contact of the posture correcting portion with the opening edge of the terminal insertion opening at the rear end of the cavity even if the terminal fitting is inserted into the cavity in an inclined posture.

The inclination restricting portion preferably is continuous with the posture correcting portion. Thus, the insertion of the terminal fitting can be completed smoothly without the front end of the inclination restricting portion getting caught by the opening edge of the cavity.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
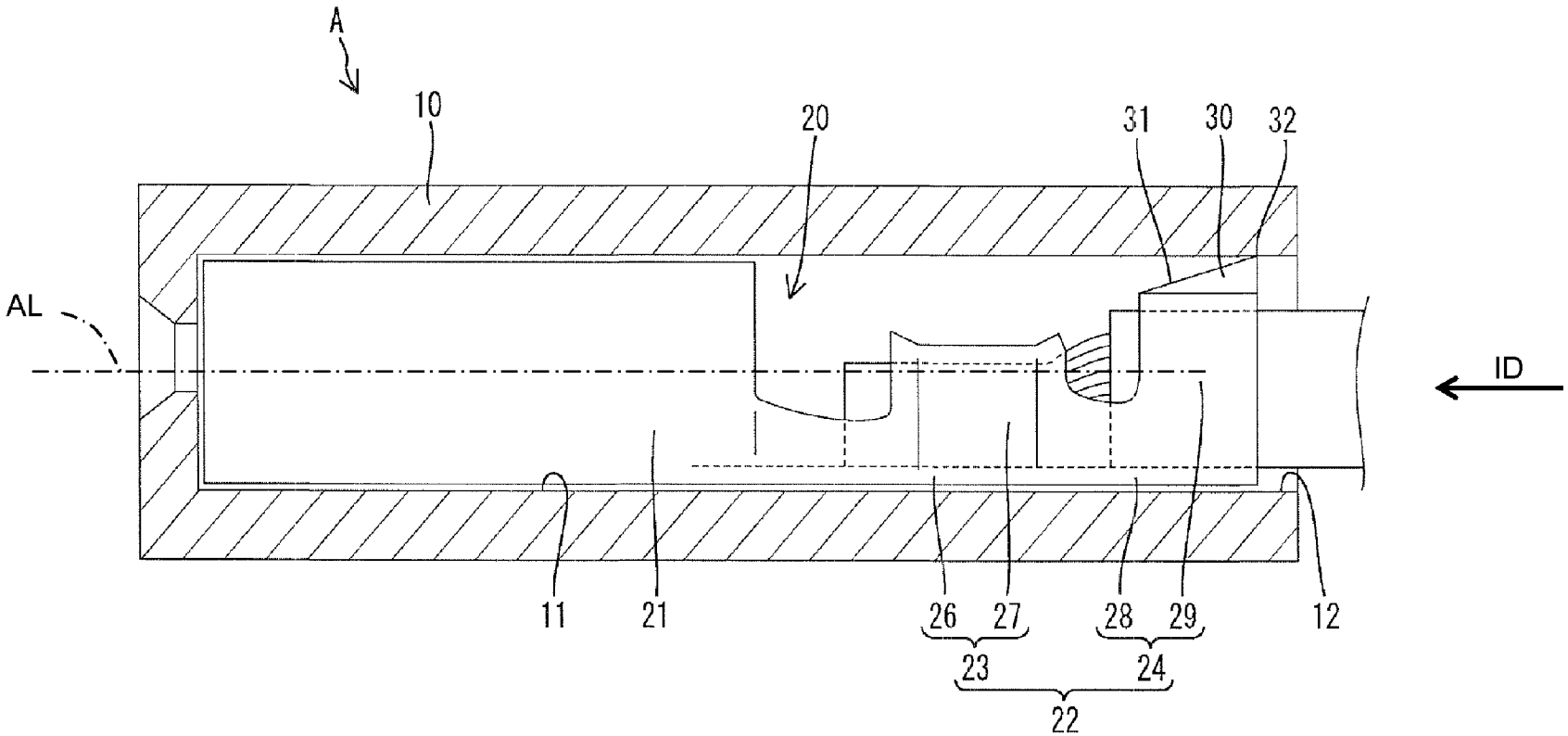
FIG. 1 is a section of a first embodiment.
Figure 2:
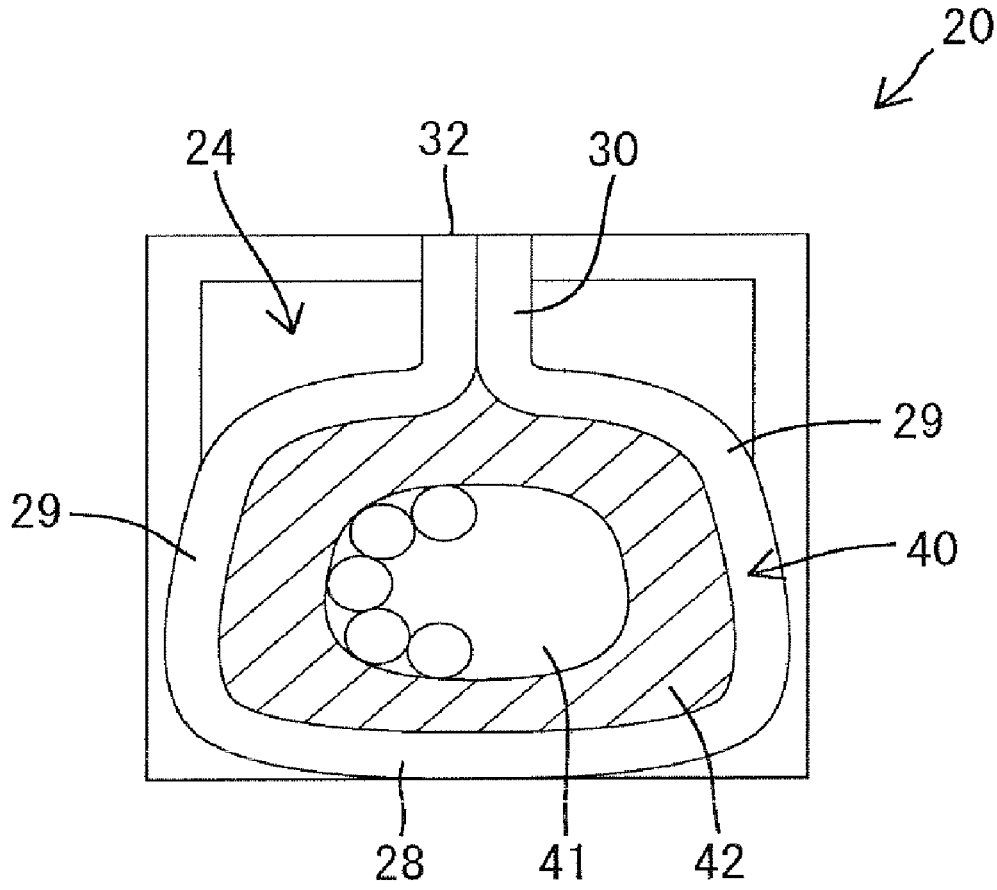
FIG. 2 is a rear view of a terminal fitting.

A connector in accordance with first embodiment of the invention is identified by the letter A in FIGS. 1 and 2. The connector A has a housing 10, at least one terminal fitting 20 and at least one wire 40.

The wire 40 generally has a known form with a conductor 41 surrounded by an insulation coating 42. The insulation coating 42 is removed adjacent the front end of the wire 40 to expose the conductor 41 prior to connection with the terminal fitting 20. The conductor 41 is a material having higher rigidity than copper (e.g. aluminum) and/or a material having lower electrical conductivity than copper (e.g. aluminum).

The housing 10 is made e.g. of a synthetic resin and a long narrow cavity 11 extends through the housing 100 in forward and backward directions. The rear end of the cavity 11 defines as a terminal insertion opening 12 in the rear end surface of the housing 10.

The terminal fitting 20 is a female terminal formed by bending, folding and/or embossing a conductive (preferably metal) plate material punched or cut out into a specified shape. A rectangular tubular terminal connecting portion 21 is defined at the front end of the terminal fitting 20. The terminal connecting portion 21 has a known form and can connect with a long narrow tab (not shown) formed on a mating male terminal.

A wire connecting portion 22 is formed at the rear end of the terminal fitting 20 and behind the terminal connecting portion 21 as seen in an inserting direction ID of the terminal fitting into the cavity 11. The wire connecting portion 22 includes at least one wire barrel 23 formed at a front end of the wire connecting portion 22 and at least one insulation barrel 24 formed behind the wire barrel 23.

The wire barrel 23 has a first bottom wall 26 and two first crimping pieces 27 project from opposite left and right sides of the first bottom wall 26. The first crimping pieces 27 can be crimped, bent or folded into electrical connection with the conductor 41 of the wire 40. Thus, the first crimping pieces 27 are deformed and wound around the conductor 41 on the first bottom wall 26. The conductor 41 is surrounded fully by the wire barrel 23. With the wire barrel 23 crimped, bent or folded into connection with the conductor 41, the height of the upper end of the wire barrel portion 23 is lower than the upper surface of the terminal connecting portion 21.

The insulation barrel 24 has a second bottom wall 28 that is substantially continuous with the first bottom wall 26 of the wire barrel 23 and two second crimping pieces 29 project from the second bottom wall 28. The insulation barrel 24 is crimped, bent or folded into connection with a part of a front end of the wire 40 covered by the insulation coating 42. The crimped, bent or folded second crimping pieces 29 are deformed and wound at least partly around the wire 40 placed on the second bottom wall 28 so that the wire 40 is surrounded by the insulation barrel 24.

The crimping process is carried out to form a projection 30 at the extending ends of the second crimping pieces 29 of the insulation barrel 24. The projection 30 projects away from the second bottom wall 28 and is defined by left and right plates that are in face-to-face contact. Each plate of the projection 30 has a substantially triangular shape when viewed in a lateral direction orthogonal to an axial line of the wire 40. The projection 30 extends continuously from the front end to the rear end of the insulation barrel 24. The front end of the projection 30 is closest to the second bottom wall 28, the rear end is farthest from the second bottom wall 28, and the upper edge of the projection 30 slopes down toward the front. The outer edge of the projection 30 defines as a posture correcting portion 31 from the front end to the rear end. Further, the highest point at the rear end of the projection 30 defines an inclination restricting portion 32. The lower surface of the second bottom wall 28 of the insulation barrel 24 is at substantially the same height as the lower surface of the bottom wall of the terminal connecting portion 21, and the upper edge of the inclination restricting portion 32 is at substantially the same height (radial position) as the upper surface of the terminal connecting portion 21.

The terminal fitting 20 is inserted into the cavity 11 from behind and along the inserting direction ID. The terminal fitting 20 inserted to a substantially proper position is retained by an unillustrated known locking lance. With the terminal fitting 20 inserted, the wire 40 is drawn out backward from the rear surface of the housing 10. Only tiny clearances are defined at the front end of the terminal fitting 20 between the upper and lower surfaces of the terminal connecting portion 21 and the ceiling and bottom surfaces of the cavity 11 for smoothing insertion of the terminal fitting 20 into the cavity 11. Thus, there is no space where the terminal fitting 20 vertically shakes.

Only a tiny clearance is defined at the rear end of the terminal fitting 20 between the lower surface of the second bottom wall 28 and the inclination restricting portion 32 for smoothing the insertion of the terminal fitting 20 into the cavity 11. Thus, there is no space where the terminal fitting 20 vertically shakes. Accordingly, the contact of the second bottom wall 28 with the bottom surface of the cavity 11 or the contact of the inclination restricting portion 32 with the ceiling of the cavity 11 prevents the terminal fitting 20 from inclining in the cavity 11 even if an external force acts on the wire 40 in a direction intersecting a draw-out direction from the housing 10.

The outer diameter of the wire 40 is smaller than the terminal connecting portion 21. Thus, the terminal fitting 20 may be inserted in an inclined posture due to a space between an inner wall of the cavity 11 and the insulation barrel 24. However, the insulation barrel 24 is formed with the at least one posture correcting portion 31 inclined with respect to the axial line AL of the terminal fitting 20 and with respect to the inserting direction ID of the terminal fitting 20 into the cavity 11. Therefore, the posture of the terminal fitting 20 is corrected by the sliding contact of the posture correcting portion 31 with the opening edge of the terminal insertion opening 12 of the cavity 11 even if the terminal fitting 20 is inserted in an inclined posture into the cavity 11.

Further, the inclination restricting portion 32 is continuous with the rear end of the posture correcting portion 31. Thus, the insertion of the terminal fitting 20 can be completed smoothly without the front end of the inclination restricting portion 32 getting caught by the opening edge of the terminal insertion opening 12 of the cavity 11.

Figure 3:
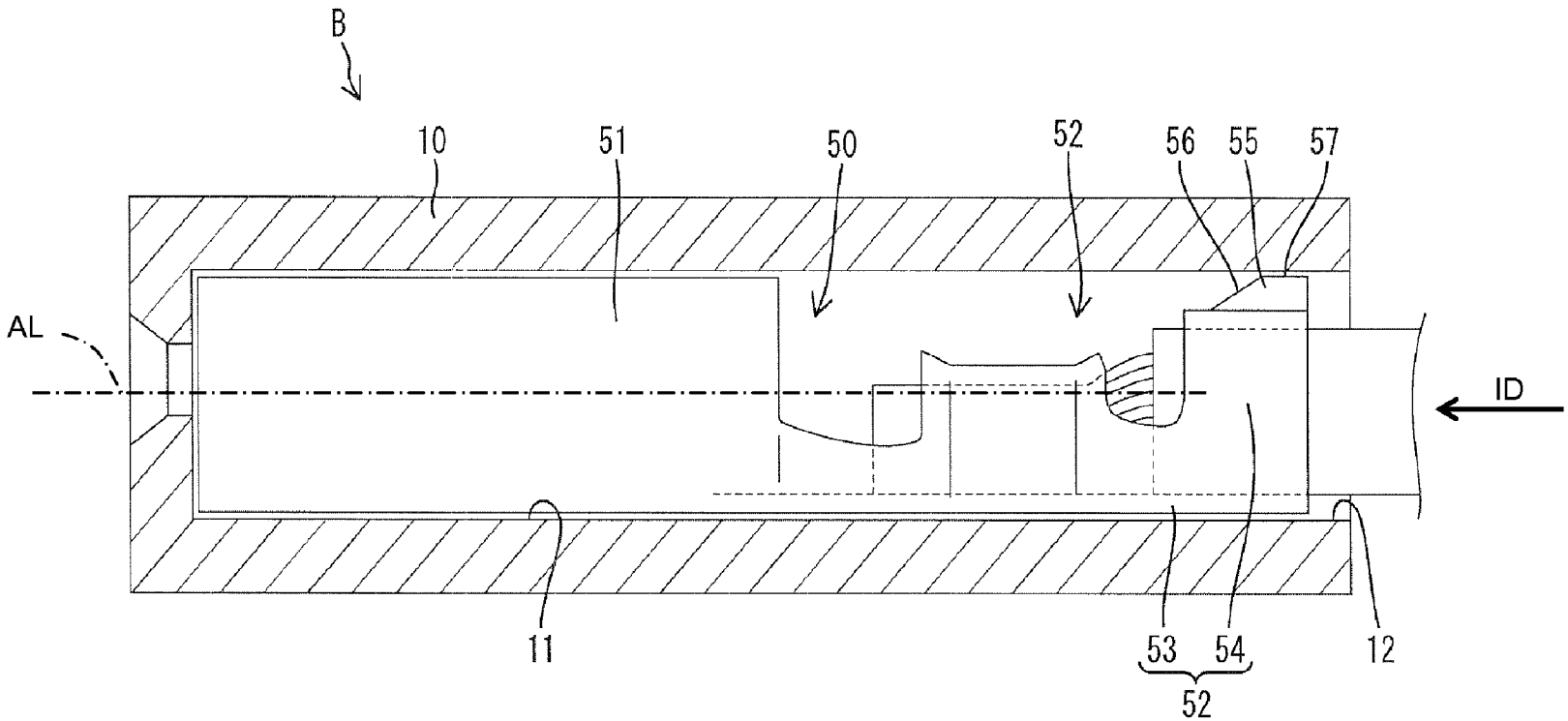
FIG. 3 is a section of a second embodiment.

A connector in accordance with a second embodiment of the invention is identified by the letter B in FIG. 3. The connector B of the second embodiment differs from the first embodiment in the constructions of the inclination restricting portion 57 and the posture correcting portion 56 formed in an insulation barrel 52 of a terminal fitting 50. The elements that are the same as or similar to the first embodiment are identified by the same reference numerals but are not described again.

The insulation barrel 52 has second crimping pieces 52 that project up from opposite sides of a second bottom wall 53. The second crimping pieces 52 are crimped, bent or folded into connection with the wire 40. The crimping process is carried out to form a projection 55 at the extending ends of the second crimping pieces 54. The projection 55 projects away from the second bottom wall 53 and is formed by left and right plates that are in face-to-face contact. Each plate of the projection 55 has a non-isosceles trapezoidal shape when viewed in a lateral direction orthogonal to an axial line of the wire 40 and is formed continuously from a position behind the front end of the insulation barrel 52 to the rear end of the insulation barrel 52.

The posture correcting portion 56 is defined by the upper edge at the front end of the projection 55 inclines down toward the front. The front end of the posture correcting portion 56 is closest to the second bottom wall 53 and the rear end thereof is farthest from the second bottom wall 53. The inclination restricting portion 57 is defined by the upper edge at the rear end of the projection 55 has a substantially constant height. The lower surface of the second bottom wall 53 of the insulation barrel 52 preferably is at substantially the same height as the lower surface of the bottom wall of the terminal connecting portion 51, and the upper or outer edge of the inclination restricting portion 57 is at substantially the same height as the upper surface of the terminal connecting portion 51.

A vertical inclination of the terminal fitting 50 inserted into the cavity 11 in the inserting direction ID is restricted by contact of the second bottom wall 53 or the inclination restricting portion 57 of the insulation barrel 52 with an inner surface of the cavity 11. Further, when the terminal fitting 50 is inserted in an inclined posture into the cavity 11, the posture correcting portion 56 slides in contact with the opening edge of the terminal insertion opening 12 to correct the posture of the terminal fitting 50.

The inclination restricting portion 57 is substantially continuous with the rear end of the posture correcting portion 56. Thus, the terminal fitting 50 is inserted smoothly without the front end of the inclination restricting portion 57 catching the opening edge of the terminal insertion opening 12 of the cavity 11.

The invention is not limited to the above described and illustrated embodiments. For example, the following embodiments are also embraced by the technical scope of the present invention as defined by the claims.

The inclination restricting portion is continuous with the rear end of the posture correcting portion in the above embodiments. However, it may be spaced back from the rear end of the posture correcting portion.

The terminal fitting is a female terminal fitting in the above embodiments. However, the invention is also applicable to a male terminal fitting with a long narrow tab at the leading end.

The terminal fitting is described as being connected to the wire by crimping. However, any other connection thereto is possible, such as insulation displacement or the like.

What is claimed is:

1. A terminal fitting having opposite front and rear ends spaced apart along an axial line, comprising:

a terminal connecting portion at the front end and configured for connection with a mating terminal; and a crimping barrel in proximity to the rear end of the terminal fitting and having a bottom wall, first and second crimping pieces extending from the bottom wall and crimped into connection with an outer periphery of a wire, plates extending from ends of the crimping pieces remote from the bottom wall, the plates being disposed substantially in face-to-face contact to define a projection, a posture correcting edge being defined at a front outer part of the projection and sloping toward the bottom wall at positions closer to the front end, an inclination restricting portion being defined on the projection rearward of the posture correcting edge and defining a part of the projection that is farthest from the bottom wall.

2. The terminal fitting of claim 1, wherein each of the plates is substantially triangular, and the inclination restricting portion defining a point of the triangular plate.

3. The terminal fitting of claim 1, wherein each of the plates is substantially a trapezoid, and the inclination restricting portion defining a edge of the trapezoidal plate.

4. The terminal fitting of claim 1, wherein the terminal connecting portion defines a maximum height measured normal to the bottom wall and wherein the inclination restricting portion is spaced from an outer surface of the bottom wall by a distance substantially equal to the maximum height of the terminal connecting portion.

5. The terminal fitting of claim 1, further comprising a core connecting portion forward of the insulation barrel and configured for connection to a conductive core of the wire.

6. A connector, comprising:

a housing formed with at least one cavity therein;

a wire having a conductor at least partly surrounded by an insulation coating;

at least one terminal fitting having opposite front and rear ends spaced apart along an axial line, a terminal connecting portion at the front end thereof and configured for connection with a mating terminal, a wire connecting portion behind the terminal connecting portion and being configured to be connected with a wire, the wire connection portion being formed with a crimping barrel in proximity to the rear end of the terminal fitting and having a bottom wall, first and second crimping pieces extending from the bottom wall and crimped into connection with an outer periphery of wire, plates extending from ends of the crimping pieces remote from the bottom wall, the plates being disposed substantially in face-to-face contact to define a projection, at least one inclination restricting portion disposed at a rear outer part of the projection and configured for restricting an inclination of the terminal fitting in a direction intersecting the axial line direction by contacting an inner wall of the cavity, and at least one posture correcting portion at a front part of the projection and inclined with respect to the axial line direction of the terminal fitting, the posture correcting portion being disposed for sliding contact with an opening edge of the cavity while inserting the terminal fitting into the cavity; and a wire having a conductor at least partly surrounded by an insulation coating, the wire connecting portion being connected with the wire surrounded by the insulation coating.

7. The connector of claim 6, wherein the posture correcting portion slopes towards the bottom wall of the terminal fitting at a position closer to the front end.

8. The connector of claim 6, wherein the inclination restricting portion defines a part of the projection that is farthest from the bottom wall of the terminal fitting.

9. The connector of claim 6, wherein each of the plates is substantially triangular, and the inclination restricting portion defines a point of the triangular plate.

10. The connector of claim 6, wherein each of the plates is substantially a trapezoid, and the inclination restricting portion defines a edges of the plates.

11. The connector of claim 6, further comprising a core connecting portion forward of the insulation barrel and configured for connection to a conductive core of the wire.

* * * * *